US011841026B2

(12) United States Patent
Harrison et al.

(10) Patent No.: US 11,841,026 B2
(45) Date of Patent: Dec. 12, 2023

(54) COMPRESSOR INTERSTAGE THROTTLE, AND METHOD OF OPERATING THEROF

(71) Applicant: TRANE INTERNATIONAL INC., Davidson, NC (US)

(72) Inventors: Mark W. Harrison, Onalaska, WI (US); Jon Christopher Johnson, New Albin, IA (US)

(73) Assignee: TRANE INTERNATIONAL INC., Davidson, NC (US)

( * ) Notice: Subject to any disclaimer, the term of this patent is extended or adjusted under 35 U.S.C. 154(b) by 223 days.

(21) Appl. No.: 17/453,454

(22) Filed: Nov. 3, 2021

(65) Prior Publication Data

US 2023/0139727 A1 May 4, 2023

(51) Int. Cl.

| | |
|---|---|
| ***F04D 27/00*** | (2006.01) |
| ***F04D 17/12*** | (2006.01) |
| ***F04D 29/22*** | (2006.01) |
| ***F04D 29/44*** | (2006.01) |

(52) U.S. Cl.
CPC ..... *F04D 27/003* (2013.01); *F04D 17/122* (2013.01); *F04D 29/2255* (2013.01); *F04D 29/441* (2013.01)

(58) Field of Classification Search
CPC .. F04D 27/003; F04D 17/122; F04D 29/2255; F04D 29/441
See application file for complete search history.

(56) References Cited

U.S. PATENT DOCUMENTS

| | | | |
|---|---|---|---|
| 3,362,625 | A | 1/1968 | Endress |
| 3,619,078 | A | 11/1971 | Mount |
| 4,460,310 | A | 7/1984 | Plunkett |
| 4,695,224 | A | 9/1987 | Lown |
| 6,293,103 | B1 | 9/2001 | Gladden |
| 6,872,050 | B2 | 3/2005 | Nenstiel |

(Continued)

FOREIGN PATENT DOCUMENTS

| | | | |
|---|---|---|---|
| CN | 113586504 | A | 11/2021 |
| EP | 3171034 | A1 | 5/2017 |

(Continued)

OTHER PUBLICATIONS

Extended European Search Report; European Patent Application No. 22204571.8, dated Mar. 13, 2023 (11 pages).

(Continued)

*Primary Examiner* — Sabbir Hasan

(74) *Attorney, Agent, or Firm* — Hamre, Schumann, Mueller & Larson, P.C.

(57) ABSTRACT

An interstage throttle for a centrifugal compressor includes a flow guide plate, a throttle ring, a drive ring, and linkage assemblies. The flow guide plate includes guide vanes that form channels that direct working fluid in between stages of the compressor. The linkage assemblies connect the drive ring to the throttle ring such that rotation of the drive ring moves the throttle ring in an axial direction. Teeth of the throttle ring partially block the channels when the throttle ring is in an extended position. A method of operating a centrifugal compressor includes directing the working fluid discharged from the first stage to a second stage via channels in a interstage throttle. A centrifugal compressor includes a first stage with a first impeller, a second stage with a second impeller, and an interstage throttle fluidly connecting the first stage to the second stage.

18 Claims, 12 Drawing Sheets

(56) References Cited

U.S. PATENT DOCUMENTS

| | | | |
|---|---|---|---|
| 7,025,557 | B2 | 4/2006 | Japikse et al. |
| 7,326,027 | B1 | 2/2008 | Skoch et al. |
| 7,553,122 | B2 | 6/2009 | Kirtley |
| 7,641,439 | B2 | 1/2010 | Chen |
| 7,905,102 | B2 | 3/2011 | Bodell et al. |
| 8,567,207 | B2 | 10/2013 | Sommer et al. |
| 8,632,302 | B2 | 1/2014 | Sorokes et al. |
| 9,353,765 | B2 | 5/2016 | Haley et al. |
| 9,382,910 | B2 | 7/2016 | Jan et al. |
| 9,382,911 | B2 | 7/2016 | Sun et al. |
| 9,388,815 | B2 | 7/2016 | Chen et al. |
| 2004/0109757 | A1 | 6/2004 | Nenstiel |
| 2007/0147987 | A1 | 6/2007 | Kirtley |
| 2012/0186605 | A1 | 7/2012 | Nakaniwa |
| 2014/0341710 | A1 | 11/2014 | Creamer |
| 2015/0128640 | A1 | 5/2015 | Sun et al. |
| 2017/0198724 | A1 | 7/2017 | Konno |
| 2018/0119569 | A1 | 5/2018 | Masuda |
| 2019/0024528 | A1 | 1/2019 | Baldassarre et al. |
| 2019/0285072 | A1 | 9/2019 | Masutani et al. |
| 2020/0109720 | A1 | 4/2020 | Turner et al. |

FOREIGN PATENT DOCUMENTS

| | | |
|---|---|---|
| JP | S60-132099 | 7/1985 |
| JP | 3653005 | 5/2005 |
| KR | 100814619 | 3/2008 |
| WO | 2013/165841 | 11/2013 |
| WO | 2017/007708 | 1/2017 |

OTHER PUBLICATIONS

Extended European Search Report; European Patent Application No. 22204569.2, dated Mar. 13, 2023 (11 pages).

Extended European Search Report, European Patent Application No. 21170478.8, dated Sep. 22, 2021 (5 pages).

COMPRESSOR INTERSTAGE THROTTLE, AND METHOD OF OPERATING THEROF

FIELD

This disclosure relates generally to a centrifugal compressor. More specifically, this disclosure relates to an interstage throttle used in a multistage centrifugal compressor in a heating, ventilation, air conditioning, and refrigeration (HVACR) system.

BACKGROUND

A compressor can include multiple stages in series for compressing a working fluid. A centrifugal compressor can include an impeller in each of its stages for compressing the working fluid. For example, working fluid is compressed in a first stage, flows from the first stage to a second stage, and is then further compressed in the second stage to a higher pressure. A centrifugal compressor can be configured to guide the working fluid discharged from the first stage to the second stage. HVACR systems are generally used to heat, cool, and/or ventilate an enclosed space (e.g., an interior space of a commercial building or a residential building, an interior space of a refrigerated transport unit, or the like). A HVACR system can include a heat transfer circuit with a compressor configured to compress a working fluid flowing through the heat transfer circuit.

BRIEF SUMMARY

In an embodiment, an interstage throttle for a centrifugal compressor includes a flow guide plate, a throttle ring with teeth, a drive ring, and linkage assemblies. The flow guide plate includes a plurality of guide vanes that forms channels extending radially inward. The channels are configured to direct working fluid discharged from a first stage of the centrifugal compressor to an inlet of a second stage of the centrifugal compressor. The linkage assemblies connect the drive ring to the throttle ring such that rotation of the drive ring moves the throttle ring in an axial direction relative to the flow guide plate between a retracted position and an extended position. In the extended position, the teeth of the throttle ring are disposed in and partially block the channels.

In an embodiment, the teeth of the throttle ring block less of the channels in the retracted position than in the extended position.

In an embodiment, the throttle ring includes radial shafts and each of the linkage assemblies include pairs of a drive linkage and a support linkage connected to the radial shafts of the throttle ring. The drive linkage and the support linkage in each of the pairs are connected to the same respective one of the radial shafts on the throttle ring.

In an embodiment, the centrifugal compressing includes a housing. The flow guide plate, the throttle ring, and the drive ring are disposed within the housing. The drive linkages connect the drive ring to the throttle ring and are configured to transfer rotation of the drive ring into axial movement of the throttle ring. The support linkages connect the throttle ring to the housing and are configured to prevent rotation of the throttle ring.

In an embodiment, in each pair of drive linkage and support linkage, the drive linkage has a first end rotatably connected to the respective radial shaft on the throttle ring and a second end rotatably connected to a respective radial shaft on the drive ring.

In an embodiment, in each pair of drive linkage and support linkage, the support linkage has a first end connected to the respective radial shaft on the throttle ring and a second end connected to the housing of the interstage throttle.

In an embodiment, the centrifugal compressor includes an actuator and an actuation linkage assembly. The actuation linkage assembly connects the actuator to the drive ring. Extending of the actuator causes rotation of the drive ring. The retraction of the actuator causes an opposite rotation of the drive ring.

In an embodiment, the rotation of the throttle ring from the retracted position to the extended position is less than 5 degrees.

In an embodiment, the flow guide plate has a fixed position in the interstage throttle.

In an embodiment, a method of operating a centrifugal compressor includes compressing a working fluid to a first pressure in the first stage, and directing the working fluid discharged from the first stage to a second stage via channels in a interstage throttle. The interstage throttle includes a flow guide plate with a plurality of guide vanes. The guide vanes form the channels which extend radially inward. The interstage throttle also includes a throttle ring, a drive ring, and linkage assemblies that connect the drive ring to the throttle ring. The directing of the working fluid via the channels includes rotating the drive ring which moves the throttle ring in an axial direction relative to the flow guide plate between a retracted position and an extended position. The throttle ring in the extended position having teeth disposed in and partially blocking the channels.

In an embodiment, the method also includes further compressing the working fluid in the second stage from the first pressure to a second pressure.

In an embodiment, the rotating of the drive ring includes extending or retracting an actuator connected to the drive ring, the extending or retracting of the actuator causing the rotation of the drive ring.

In an embodiment, a centrifugal compressor includes a first stage, a second stage, and an interstage throttle fluidly connecting the first stage to the second stage. The first stage includes a first impeller configured to compress working fluid to a first pressure. The second stages a second impeller configured to compress the working fluid to a second pressure. The interstage throttle includes a flow guide plate, a throttle ring with teeth, a drive ring, and linkage assemblies. The flow guide plate includes a plurality of guide vanes that forms channels extending radially inward. The channels configured to direct working fluid discharged from a first stage of the centrifugal compressor to an inlet of a second stage of the centrifugal compressor. The linkage assemblies connect the drive ring to the throttle ring such that rotation of the drive ring moves the throttle ring in an axial direction relative to the flow guide plate between a retracted position and an extended position. In the extended position, the teeth of the throttle ring are disposed in and partially block the channels.

In an embodiment, the teeth of the throttle ring block less of the channels in the retracted position than in the extended position.

In an embodiment, the throttle ring includes radial shafts, each of the linkage assemblies include pairs of a drive linkage and a support linkage connected to the radial shafts of the throttle ring. The drive linkage and the support linkage in each of the pairs are connected to the same respective one of the radial shafts on the throttle ring.

In an embodiment, the centrifugal compressor also includes a housing. The flow guide plate, the throttle ring, and the drive ring are disposed within the housing. The drive linkages connect the drive ring to the throttle ring and are configured to transfer rotation of the drive ring into axial movement of the throttle ring. The support linkages connect the throttle ring to the housing and are configured to prevent rotation of the throttle ring.

In an embodiment, the centrifugal compressor also includes an actuator and an actuation linkage assembly connecting the actuator to the drive ring. Extending the actuator causes rotation of the drive ring, and retraction of the actuator causes the opposite rotation of the drive ring.

In an embodiment, the centrifugal compressor includes a housing. The flow guide plate, the throttle ring, and the drive ring are disposed within the housing. The actuator is external to the housing and the actuation linkage assembly extends through the housing.

In an embodiment, the rotation of the throttle ring from the retracted position to the extended position is less than 5 degrees.

In an embodiment, the flow guide plate is configured to have a fixed position within the centrifugal compressor.

BRIEF DESCRIPTION OF THE DRAWINGS

FIG. 8 shows the throttle ring in an extended position. FIG. 9 shows the throttle ring in a reacted position.

FIG. 10 shows the throttle ring in a retracted position. FIG. 11 shows the throttle ring in an extended position.

Like reference numbers represent like parts throughout.

DETAILED DESCRIPTION

A heating, ventilation, air conditioning, and refrigeration ("HVACR") system can include a heat transfer circuit configured to heat or cool a process fluid (e.g., air, water and/or glycol, or the like). The heat transfer circuit includes a compressor that compresses a working fluid circulated through the heat transfer circuit. The compressor includes a first stage with a first impeller and a second stage with a second impeller. The first stage configured to compress the working fluid to a first pressure and the second stage configured to further compress the working fluid discharged from the first stage. An interstage throttle directs the working fluid from the first stage to the inlet of the second stage.

Embodiments described herein are directed to interstate throttles in centrifugal compressors, centrifugal compressors with an interstage throttle, HVACR systems that include centrifugal compressors, and methods of operating centrifugal compressors.

Figure 1:
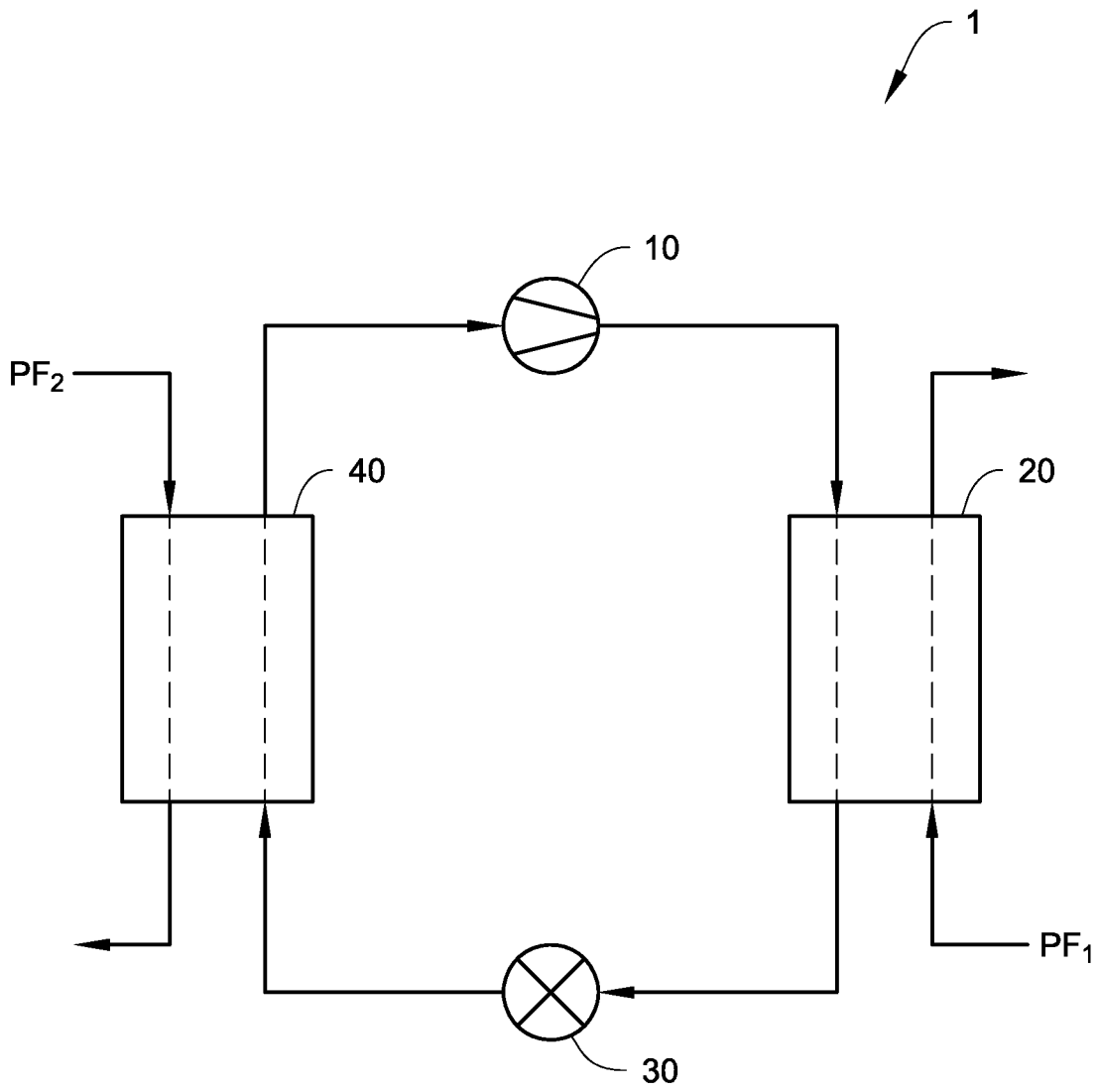
FIG. 1 is a schematic diagram of a heat transfer circuit of a HVACR system.

FIG. 1 is a schematic diagram of a heat transfer circuit 1 of a HVACR system, according to an embodiment. The heat transfer circuit 1 includes a compressor 10, a condenser 20, an expansion device 30, and an evaporator 40. In an embodiment, the heat transfer circuit 1 can be modified to include additional components. For example, the heat transfer circuit 1 in an embodiment can include an economizer heat exchanger, one or more flow control devices, a receiver tank, a dryer, a suction-liquid heat exchanger, or the like.

The components of the heat transfer circuit 1 are fluidly connected. The heat transfer circuit 1 can be configured as a cooling system (e.g., a fluid chiller of an HVACR, an air conditioning system, or the like) that can be operated in a cooling mode, and/or the heat transfer circuit 1 can be configured to operate as a heat pump system that can run in a cooling mode and a heating mode.

The heat transfer circuit 1 applies known principles of gas compression and heat transfer. The heat transfer circuit can be configured to heat or cool a process fluid (e.g., water, air, or the like). In an embodiment, the heat transfer circuit 1 may represent a chiller that cools a process fluid such as water or the like. In an embodiment, the heat transfer circuit 1 may represent an air conditioner and/or a heat pump that cools and/or heats a process fluid such as air, water, or the like.

During the operation of the heat transfer circuit 1, a working fluid (e.g., refrigerant, refrigerant mixture, or the like) flows into the compressor 10 from the evaporator 40 in a gaseous state at a relatively lower pressure. The compressor 10 compresses the gas into a high pressure state, which also heats the gas. After being compressed, the relatively higher pressure and higher temperature gas flows from the compressor 10 to the condenser 20. In addition to the working fluid flowing through the condenser 20, a first process fluid $PF_1$ (e.g., external air, external water, chiller water, or the like) also separately flows through the condenser 20. The first process fluid absorbs heat from the working fluid as the first process fluid $PF_1$ flows through the condenser 20, which cools the working fluid as it flows through the condenser. The working fluid condenses to liquid and then flows into the expansion device 30. The expansion device 30 allows the working fluid to expand, which converts the working fluid to a mixed vapor and liquid state. An "expansion device" as described herein may also be referred to as an expander. In an embodiment, the expander may be an expansion valve, expansion plate, expansion vessel, orifice, or the like, or other such types of expansion mechanisms. It should be appreciated that the expander may be any type of expander used in the field for expanding a working fluid to cause the working fluid to decrease in temperature. The relatively lower temperature, vapor/liquid working fluid then flows into the evaporator 40. A second process fluid $PF_2$ (e.g., air, water, or the like) also flows through the evaporator 40. The working fluid absorbs heat from the second process fluid $PF_2$ as it flows through the evaporator 40, which cools the second process fluid $PF_2$ as it flows through the evaporator 40. As the working fluid absorbs heat, the working fluid evaporates to vapor. The working fluid then returns to the compressor 10 from the evaporator 40. The above-described process continues while the heat transfer circuit 1 is operated, for example, in a cooling mode.

Figure 2:
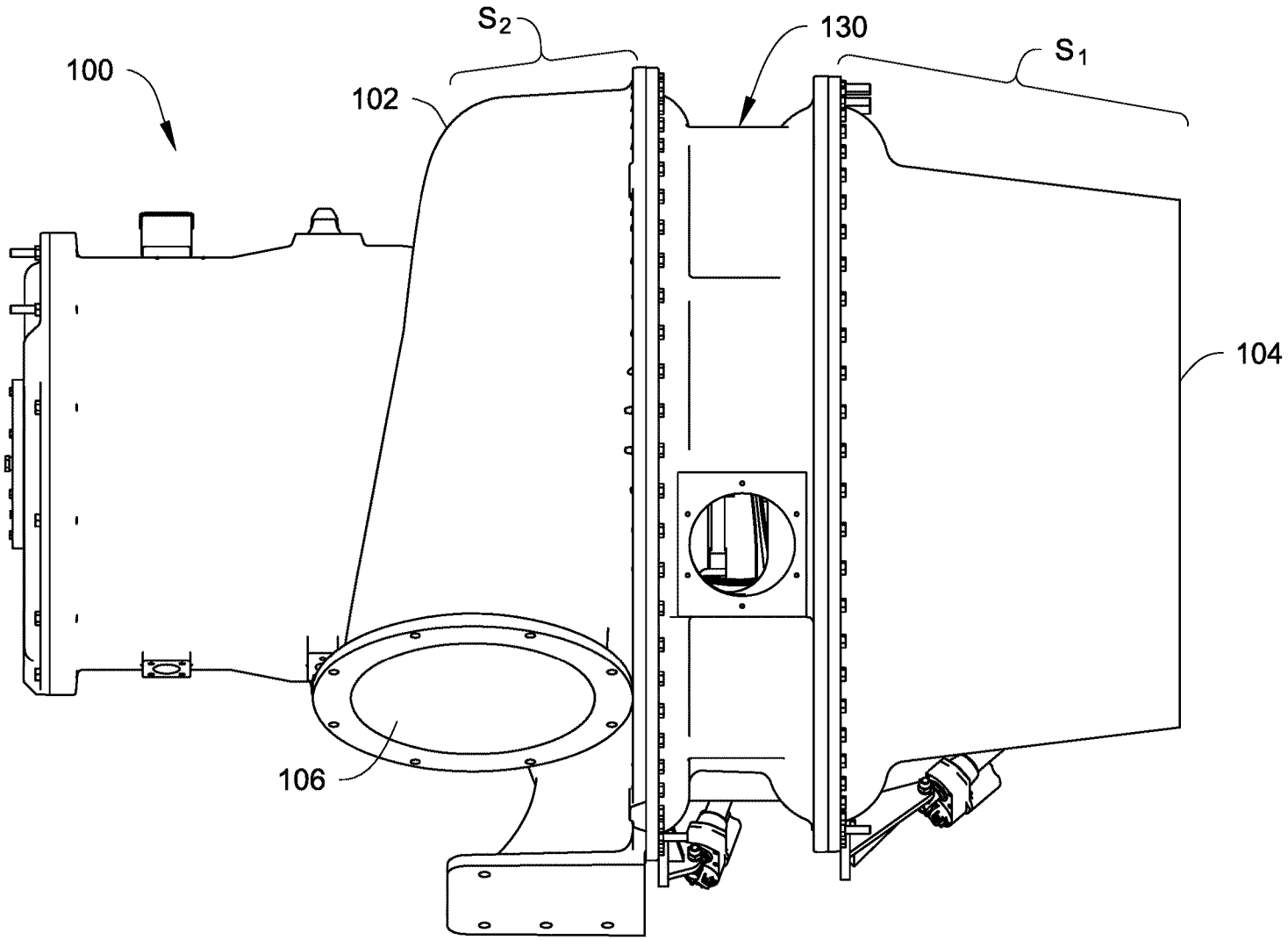
FIG. 2 is a side prospective view of an embodiment of a centrifugal compressor.

FIG. 2 is a side perspective view of an embodiment of a centrifugal compressor 100. In an embodiment, the centrifugal compressor 100 is the compressor 10 in the heat transfer circuit 1 in FIG. 1. The compressor 100 includes a housing 102 having a suction inlet 104 and a discharge outlet 106. Working fluid enters the housing 100 through the suction inlet 104, is compressed by the compressor 100, and is discharged as compressed working fluid from the discharge outlet 106. The compressor 100 includes a first stage $S_1$, a second stage $S_2$, and an interstage throttle 130. The working fluid is compressed in the first stage $S_1$ (e.g., to a first pressure $P_1$), flows from the first stage to the second stage $S_2$, and is then further compressed to a higher pressure (e.g., second pressure $P_2$) in the second stage $S_1$. The compressed working fluid discharged from the first stage $S_1$ flows from the first stage $S_1$ to the second stage $S_2$ through the interstage throttle 130. The interstage throttle 130 is configured to control a flowrate of the working fluid from the first stage $S_1$ to the second stage $S_2$.

Figure 3:
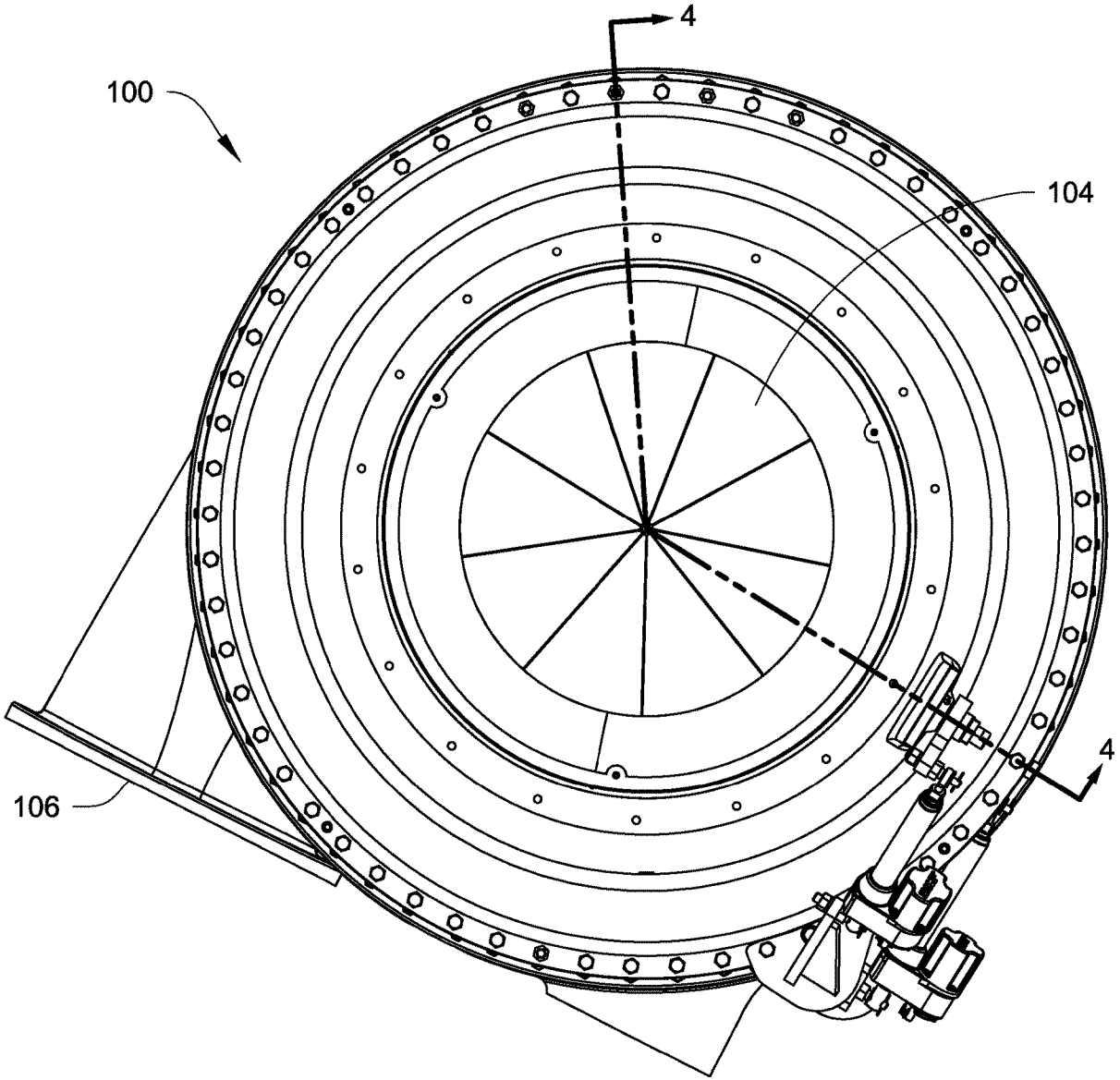
FIG. 3 is a front view of the centrifugal compressor in FIG. 2, according to an embodiment.
Figure 4:
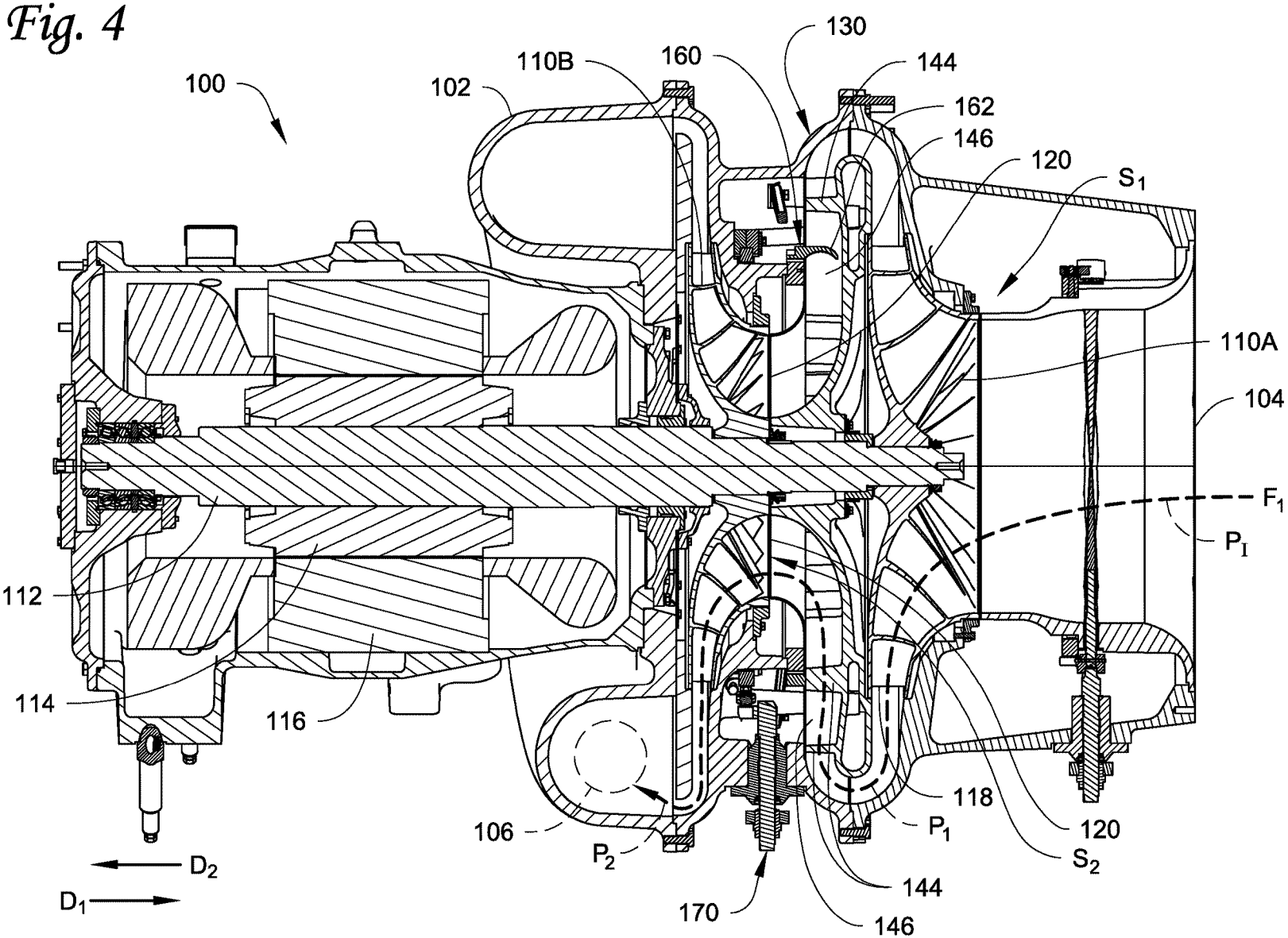
FIG. 4 is a cross-sectional view of the centrifugal compressor of FIG. 2 as indicated in FIG. 3, according to an embodiment.

FIG. 3 is a front view of the centrifugal compressor 100. FIG. 4 is a cross-sectional view of the centrifugal compressor 100 as indicated in FIG. 3. As shown in FIG. 4, the compressor 100 includes the first stage $S_1$, the second stage $S_2$, and the interstage throttle 130 that connects the first stage $S_1$ to the second stage $S_2$. The first stage $S_1$ and the second stage $S_2$ each include an impeller 110A, 110B that rotates to compress the working fluid within their respective stage $S_1$, $S_2$.

The compressor 100 also includes a driveshaft 112, a rotor 114, and a stator 116. The impellers 110A, 110B are each affixed to the driveshaft 112. For example, the first impeller 110A is affixed to an end of the driveshaft 112 while the second impeller 110B is affixed closer to a middle of the shaft 112. The rotor 114 is attached to the driveshaft 112 and is rotated by the stator 116, which rotates driveshaft 112 and the impellers 110A, 110B. The rotor 114 and stator 116 form an electric motor of the compressor 110. The electric motor (e.g., the stator 116 and the rotor 114) operates according to generally known principles. In another embodiment, the driveshaft 112 may be connected to and rotated by an external electric motor, an internal combustion engine (e.g., a diesel engine or a gasoline engine), or the like. It is appreciated that in such embodiments that the rotor 114 and the stator 116 would not be present within the housing 102 of the compressor 100. The driveshaft 112 extends through the first and second stages $S_1$ and $S_2$ as well as the interstage throttle 130 as shown in FIG. 4. It should be appreciated that the terms "axial", "radial", and "circumferential" as used herein are generally respect to the axis of the compressor 100 (e.g., the axis of the driveshaft 112), unless specified otherwise.

The flow path $F_1$ of working fluid through the compressor 100 is indicated in dashed arrows in FIG. 4. The flow path $F_1$ extends from the suction inlet 104 to the discharge outlet 106 of the compressor 100. The working fluid enters the compressor 100 through the suction inlet 104, is compressed within the first stage $S_1$ by the first impeller 110A, flows through the interstage throttle 130 to the second stage $S_2$, is further compressed in the second stage $S_2$ by the second impeller 110B, and is then discharged from the compressor 100 through the discharge 106. The first impeller 110A in the first stage $S_1$ is configured to compress the working fluid from an inlet pressure (e.g., pressure $P_1$) to a first pressure $P_1$, and the second impeller 110B in the second stage $S_2$ is configured to further compress the working fluid to a second pressure $P_2$ that is greater than the first pressure $P_1$.

In flow path $F_1$, the interstage throttle 130 is disposed between the first impeller 110A of the first stage $S_1$ and the second impeller 110B of the second stage $S_2$. The interstage throttle 130 is disposed between the outlet 118 of the first impeller $S_1$ and the inlet 120 of the second impeller 110A. The driveshaft 112 extends through the interstage throttle 130. The interstage throttle 130 fluidly connects the outlet 118 of the first impeller 110A to the inlet 120 of the second impeller 110B. The interstage throttle 130 directs the working fluid discharged from the first stage $S_1$ (e.g., the compressed working fluid at the first pressure $P_1$) to the second impeller 110B of the second stage $S_2$. For example, the interstage throttle 130 directs the compressed working fluid (after being discharged radially outward from the first impeller 110A) radially inward to the inlet 120 of the second impeller 110B. The interstage throttle 130 is adjustable to control the flowrate of the compressed working fluid flowing from the first stage $S_1$ to the second stage $S_2$. The interstage throttle 130 includes an actuator 170 for operating the interstage throttle 130. The actuator 170 is operable/actuates to adjust the flowrate of the compressed working fluid flowing through the interstage throttle 130. For example, a controller (not shown) of the compressor 100 and/or the HVACR controller may be configured to control the capacity of the compressor 100 by controlling the position/actuation of the actuator 170.

The interstage throttle 130 includes guide vanes 144 and channels 146 formed by the guide vanes 144. The channels 146 spiral radially inward and are shown in more detail in FIGS. 5 and 6. As shown in FIG. 4, the working fluid flows through interstage throttle 130 by flowing through the channels 146. The channels 146 direct the working fluid discharged from the first stage $S_1$ radially inward to the inlet 120 of the second impeller 110B. The interstage throttle 130 includes a throttle ring 160 configured to be actuated to adjust a size of the channels 146 (e.g., a cross-sectional area of the channels 146).

The throttle ring 160 includes teeth 162 that extend towards the flow guide plate 140. The throttle ring 160 is configured to be actuated in the axial direction (e.g., in direction $D_1$, in direction $D_2$) relative to the channels 146. The axial movement of the throttle ring 160 changes the length of the teeth 162 disposed in the channels 146 to adjust the cross-sectional area of the channels 146. For example, when the throttle ring 160 is actuated towards the channels 146 (e.g., in a positive axial direction $D_1$), the teeth 162 extend further into the channels 146 and reduce the cross-sectional area of the channels 146. As each tooth 162 is disposed further into its respective channel 146, the tooth 162 partially blocks more of the channel 146 and decreases the cross-sectional area of the channel 146 (e.g., decreases the open cross-sectional area in each channel). The decreased cross-sectional area of the channels 146 decreases the flowrate of the working fluid through the channels 146 and the interstage throttle 130. When the throttle ring 160 is actuated away from the channels 146 (e.g., in the negative axial direction $D_2$), the teeth 162 extend less into the channels 146 and the cross-sectional area of the channels 146 is increased, which increases the flow of the working fluid through the interstage throttle 130. For example, the throttle ring 160 in an embodiment may have a retracted position in which the teeth 162 disposed entirely outside of the channels 146. The configuration of the interstage throttle 130 is discussed in more detail below.

Figure 5:
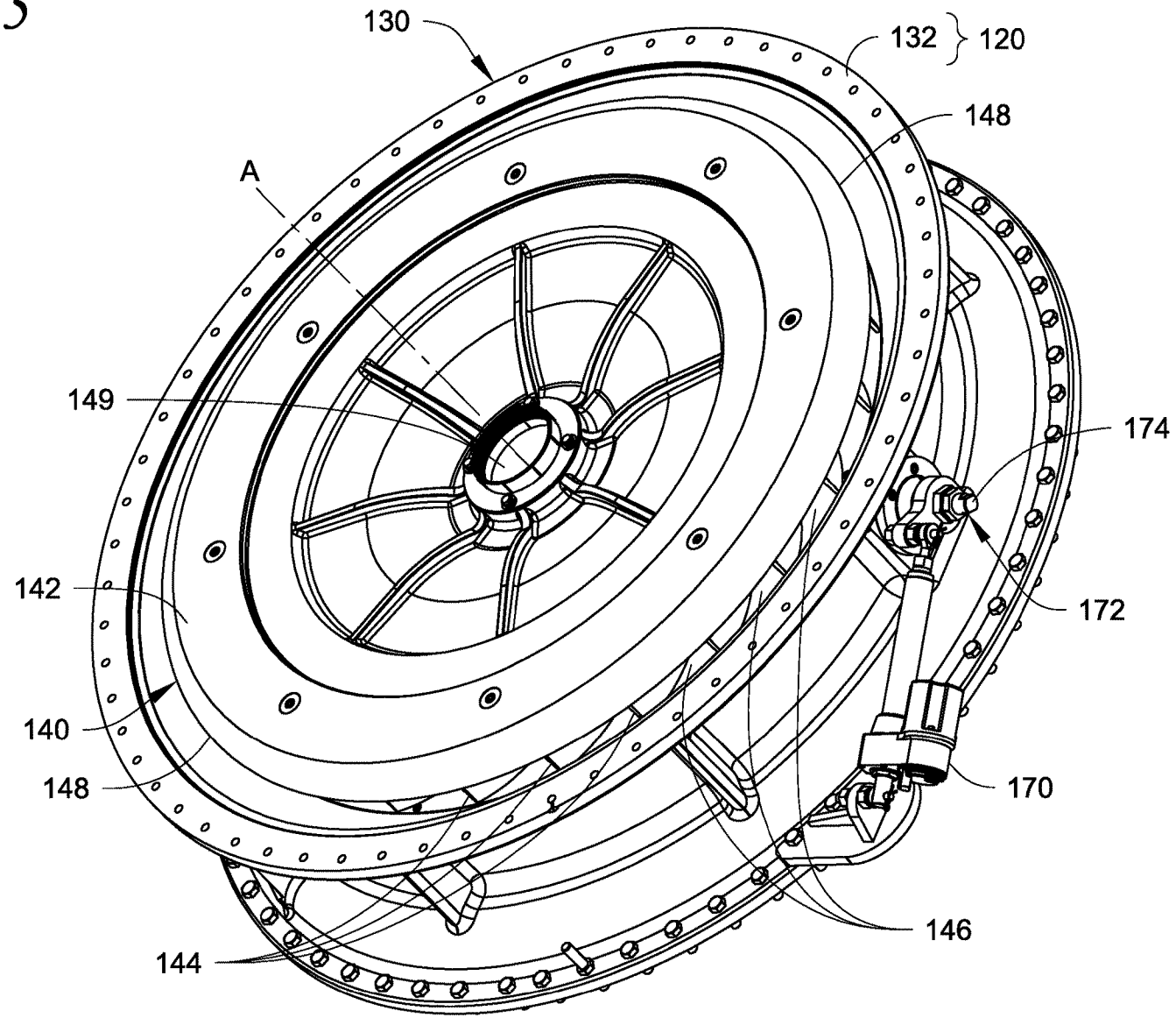
FIG. 5 is a front perspective view of an interstage throttle of the centrifugal compressor of FIG. 2, according to an embodiment.

FIG. 5 is a front perspective view of the interstage throttle 130 of the compressor 100. The interstage throttle 130 includes a housing 132, a flow guide plate 140, the actuator 170, and an actuation linkage assembly 172. The housing 132 is part of the housing 102 of the compressor 100. The housing 132 remains stationary during operation of the compressor 100 (e.g., remains stationary during rotation of the driveshaft 112).

The actuation linkage assembly 172 connects to the actuator 170 and extends through the housing 132. The actuator 170 actuates the actuation linkage assembly 172 to actuate/move the throttle ring 160 within the housing 132. For example, the actuation linkage assembly 172 includes a shaft 174 that extends through the housing 132. The actuator 170 actuates (e.g., extends, retracts) to rotate the shaft 174. As shown in FIG. 5, the actuator 170 can be mounted external to the housing 132. Actuation of the throttle ring 160 is discussed in more detail below.

The flow guide plate 140 includes a baseplate 142 and the guide vanes 144 that extend along the baseplate 142. The guide vanes 144 are provided on the baseplate 142. The flow guide plate 140 includes through-hole 149 for the driveshaft 112 (shown in FIG. 2). The axis A of the driveshaft 112/flow guide plate 140 is indicated in FIG. 5. During operation of the compressor 100, the flow guide plate 140 remains in a fixed positon relative to the housing 132 (e.g., does not rotate with the driveshaft 112). The working fluid flows through the interstage throttle 130 by flowing through the channels 146 of the flow guide plate 140. The channels 146 direct the working fluid radially inward towards a center of the flow guide plate 140 (e.g., towards the axis A of the driveshaft 112/compressor 100). The working fluid from the first stage $S_1$ enters the channels 146 along the outer edge 148 of the baseplate 142 then flows radially inward through the channels 146.

Figure 6:
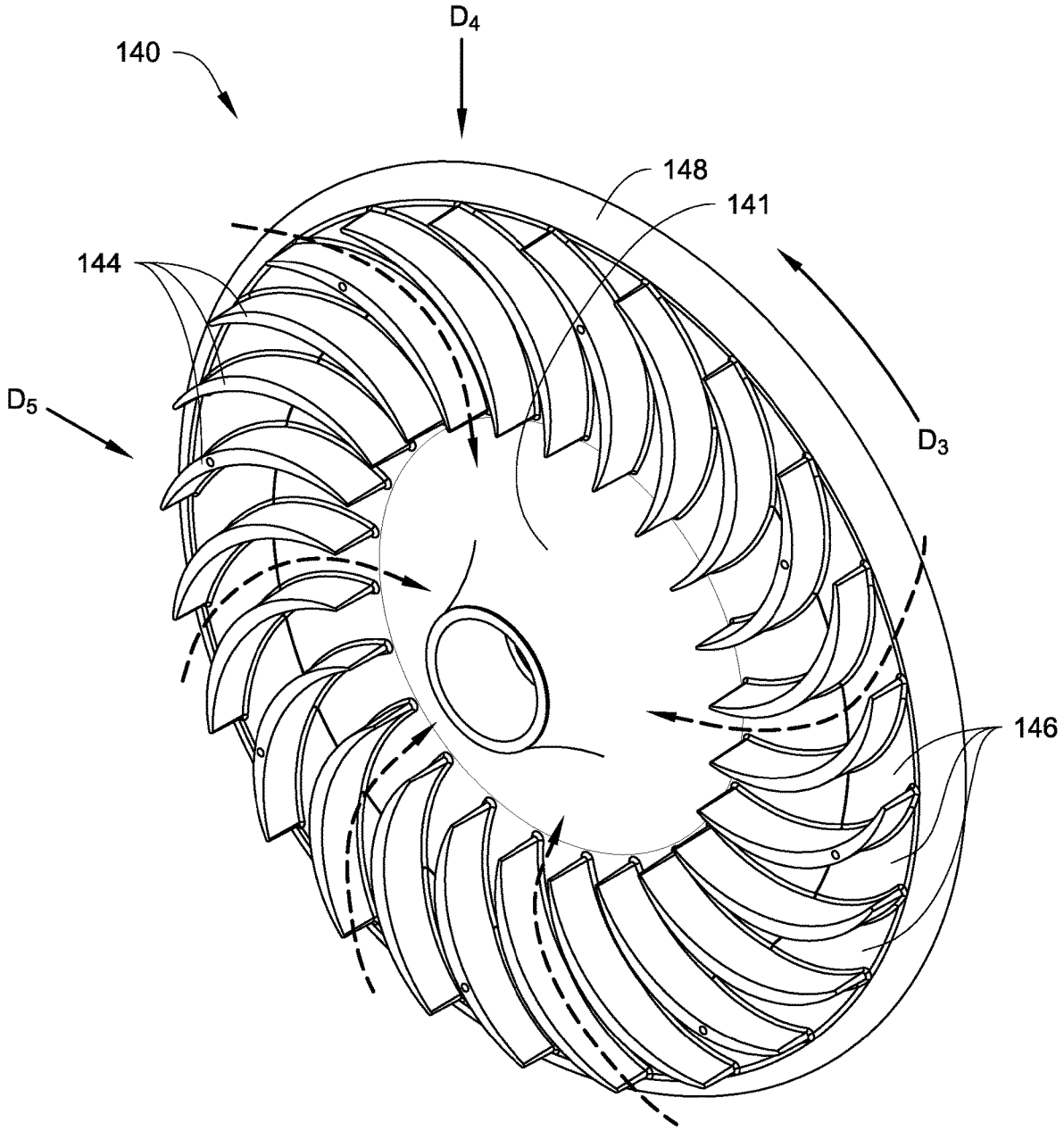
FIG. 6 is rear perspective of a flow guide plate of the interstage throttle in FIG. 5, according to an embodiment.

FIG. 6 is rear perspective of the flow guide plate 140 of the interstage throttle 130. The rear 141 of the flow guide plate 140 shown in FIG. 6 faces the interstage throttle ring 130 and the second impeller 110B of the second stage $S_2$. The channels 146 are formed between the guide vanes 144. A respective channel 146 is formed between each adjacent pair of the guide vanes 144. The guide vanes 144 and the channels 146 each extend radially inward (e.g., in direction $D_4$, in direction $D_5$, etc.). The guide vanes 144 and the channels 146 each have a spiral shape as shown in FIG. 6. The guide vanes 144 and channels 146 extending both radially inward and circumferentially along the baseplate 142. The flow direction for working fluid through the channels 146 is indicated in dashed lines in FIG. 6. The teeth 162 of the throttle ring 160 (shown in FIGS. 5 and 8-11) are configured to fit into the channels 146. For example, each tooth 162 is configured to fit into a respective channel 146 between a respective pair of the guide vanes 144. The tooth 162 has a circumferential thickness that is less than the circumferential distance between its respective pair of guide vanes 144 (e.g., the thickness of its respective channel 146 in the circumferential direction $D_3$). The throttle ring 160 is configured to be actuatable in the axial direction to move each tooth 162 in the axial direction (e.g., direction $D_1$ and direction $D_2$ in FIG. 2) into its respective channel 146.

Figure 7:
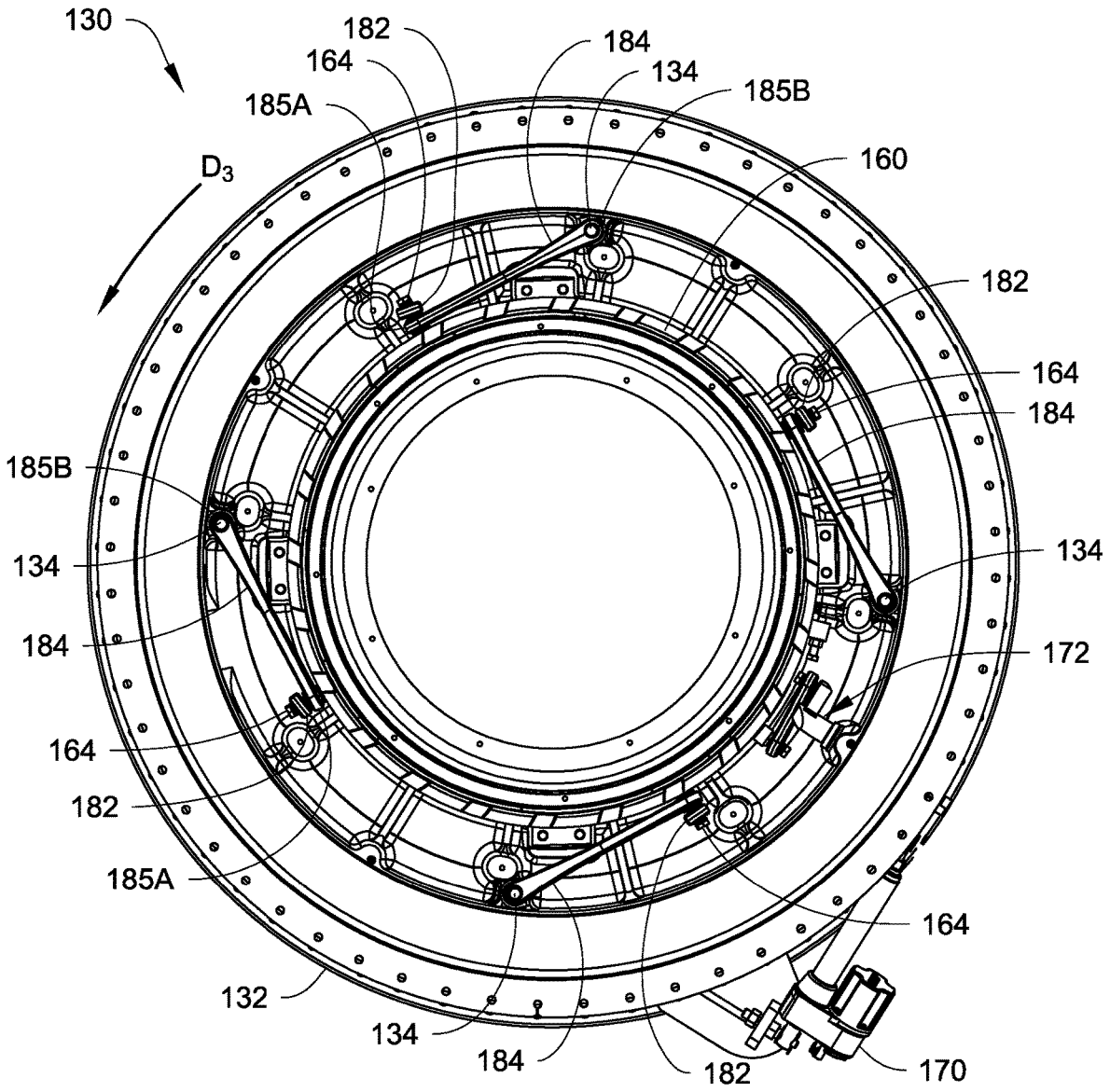
FIG. 7 is a front view of the interstage throttle in FIG. 5 with the flow guide plate omitted, according to an embodiment.
Figure 8:
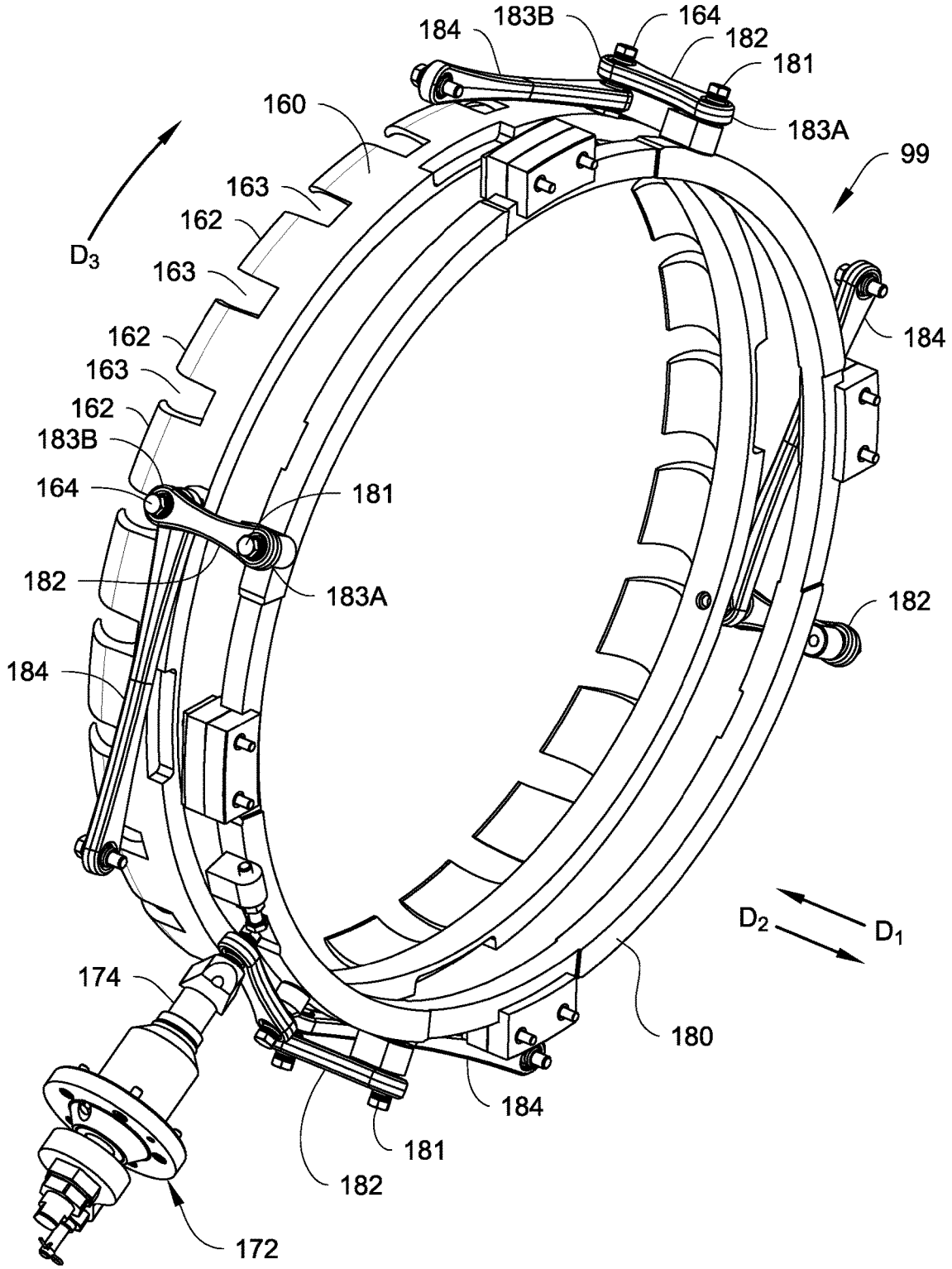
FIGS. 8 and 9 are each a rear perspective view of a throttle ring and an actuation mechanism of the interstage throttle in FIG. 5, according to an embodiment.
Figure 9:
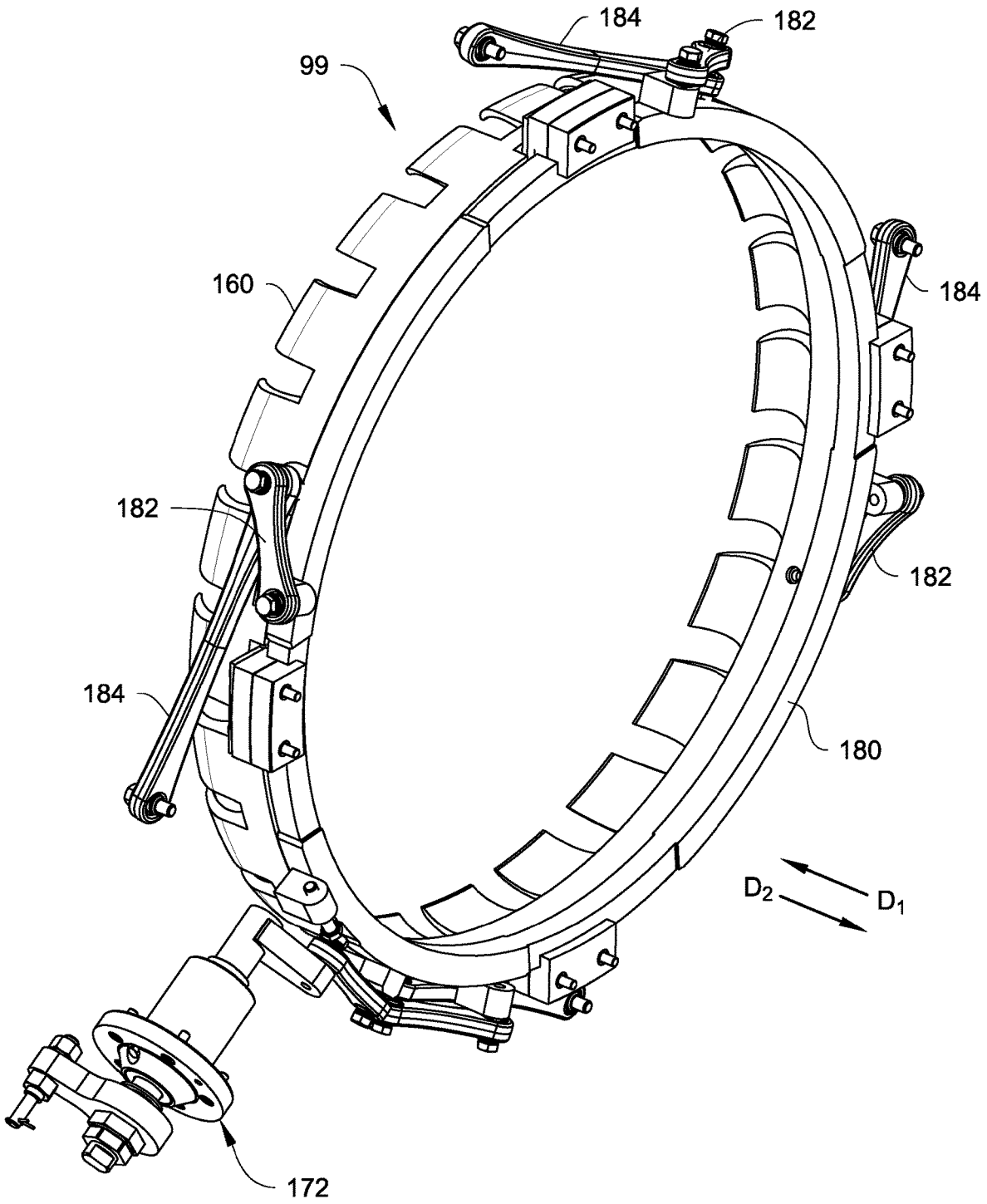

FIG. 7 is a rear perspective view of the interstage throttle 130 with the flow guide plate 140 omitted. FIGS. 8 and 9 show a rear perspective view of the throttle ring 160 and the actuation mechanism 99 of the interstage throttle 130 for actuating the throttle ring 160. FIG. 8 shows the throttle ring 160 when in its extended position. FIG. 9 shows the throttle ring 160 in its retracted position.

The actuation mechanism 99 for the throttle ring 130 includes the actuation linkage assembly 172, a drive ring 180, drive linkages 182, and support linkages 184. In the illustrated embodiment, the actuation linkage assembly 172 includes the shaft 174 and is configured to utilize the motion of the actuator 170 (e.g., linear motion, extension, retraction, etc.) to rotate the drive ring 180. For example, the linear extension of actuator 170 rotates the shaft 172 of the actuation linkage assembly 170 and the rotation of the shaft 172 in turn rotates the drive ring 180. As shown in FIGS. 8 and 9, the drive ring 180 may have at or about the same circumference as the throttle ring 160. The drive ring 180 is obscured by the throttle ring 160 in FIG. 7. In an embodiment, the circumference of the drive ring 180 and of the throttle ring 160 are less than 10% different. In another embodiment, the circumferences of the drive ring 180 and the throttle ring 160 may be less than 5% different).

The linkages 182, 184 are configured to move the throttle ring 160 in the axial direction (e.g., positive axial direction $D_1$, negative axial direction $D_2$) using the rotation of the drive ring 180. The drive linkages 182 connect the drive ring 180 to the throttle ring 160. Each of the drive linkages 182 separately extends from the drive ring 180 to the throttle ring 160. As shown in FIG. 8, the throttle ring 160 and the drive ring 180 includes radial shafts 164, 181 (e.g., pins, bolts, integral shafts, or the like) that extend radially outward from the throttle ring 160 and the drive ring 180, respectively. It should be appreciated that one or more of the radial shafts 164, 181 may extend radially inward in another embodiment. The linkages 182, 184 are rotatably connected to the radial shafts 164, 181 on the rings 160, 180. As shown in the FIGS. 8 and 9, the linkages 182, 184 can each be an arm that connects their respective structures. The linkages 182, 184 are configured to use the rotation of the drive ring 180 to move the throttle ring 160 in the axial direction with little to no rotation of the throttle ring 160.

As shown in FIG. 8, each drive linkage 182 has a first end 183B that is rotatably connected to the throttle ring 160 and a second end 183A that is rotatably attached to the drive ring 180. For example, each drive linkage 182 has a through-hole on its first end 183B that is inserted onto a respective radial shaft 164 on the throttle ring 160. For example, each drive linkage 182 has a through-hole on its second end 183A that is inserted onto a respective radial shaft 181 on the drive ring 180.

As shown in FIG. 7, each support linkage 184 has a first end 185A that is rotatably connected to the throttle ring 160 and a second end 185B that is rotatably connected to the housing 132. For example, each support linkage 184 has a through-hole on its first end 185A that is inserted onto a respective radial shaft 164 on the throttle ring 160. For example, each support linkage 184 has a through-hole on its second end 185B that is inserted onto a respective shaft 134 on the housing 132. For example, the shaft 134 on the housing 132 extends in the axial direction (e.g., in direction $D_3$ in FIG. 2).

As shown in FIG. 7, the drive linkages 182 and support linkages 184 are provided in pairs. In each drive linkage 182 and the support linkage 184 pair, the drive linkage 182 and the support linkage 184 connect to the throttle ring 160 at the same location. For example, the drive linkage 182 and the support linkage 184 in each pair is rotatably connect to the same radial shaft 164 of the throttle ring 160. The drive linkage 182 is configured to transfer the movement from the drive ring 180 (e.g., rotation of the drive ring 180) to the shaft 164 of the throttle ring 160 while the support linkage 184 is configured to limit/prevent rotation of the throttle ring 160. In the illustrated embodiment, the interstage throttle 130 includes four pairs of the drive and supports linkages 182, 184. However, it should be appreciated that the interstage throttle 130 in an embodiment may include a different number of the linkages 182, 184. For example, the interstage throttle 130 in an embodiment may include three or more pairs of the linkages 182, 184.

As shown in FIGS. 8 and 9, the linkages 182, 184 are configured so that the rotation of the drive ring 180 moves the throttle ring 160 in the axial direction with limited rotational movement. For example, the throttle ring 160 is configured to rotate less than 5 degrees between its fully retracted position to fully extend position. In an embodiment, the throttle ring 160 may be configured to rotate less than 3 degrees between its from its fully retracted position to its fully extend position. For example, the throttle ring 160 moves from its fully retracted position to its fully extended position when the actuator 170 is actuated moves from 0% extended to 100% extended, or from 100% extended to 0% extended.

As shown in FIG. 8, the teeth 162 of the throttle ring 160 are spaced apart from each other in the circumferential direction $D_3$. A respective gap 163 is formed between each circumferentially adjacent pair of teeth 162. Each gap is configured to accept a respective one of the guide vanes 144 (omitted in FIG. 8) when the throttle ring 160 is in its extended position (e.g., see FIG. 11).

Figure 10:
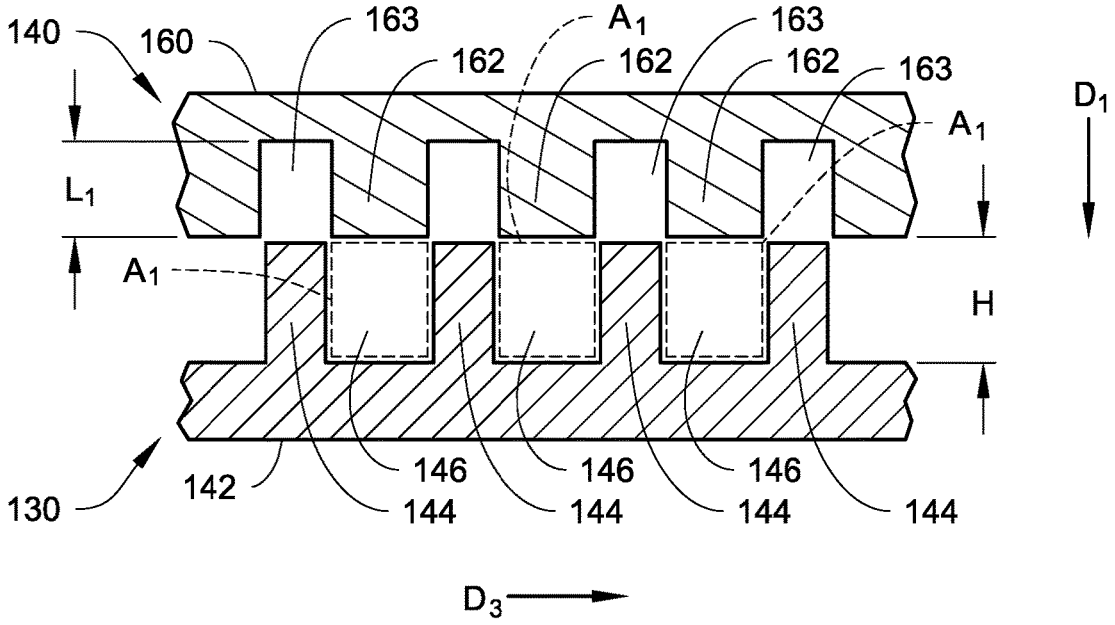
FIGS. 10 and 11 are each a schematic diagrams illustrating the intermeshing of a throttle ring and the flow guide plate of the interstage throttle of FIG. 6, according to an embodiment.
Figure 11:
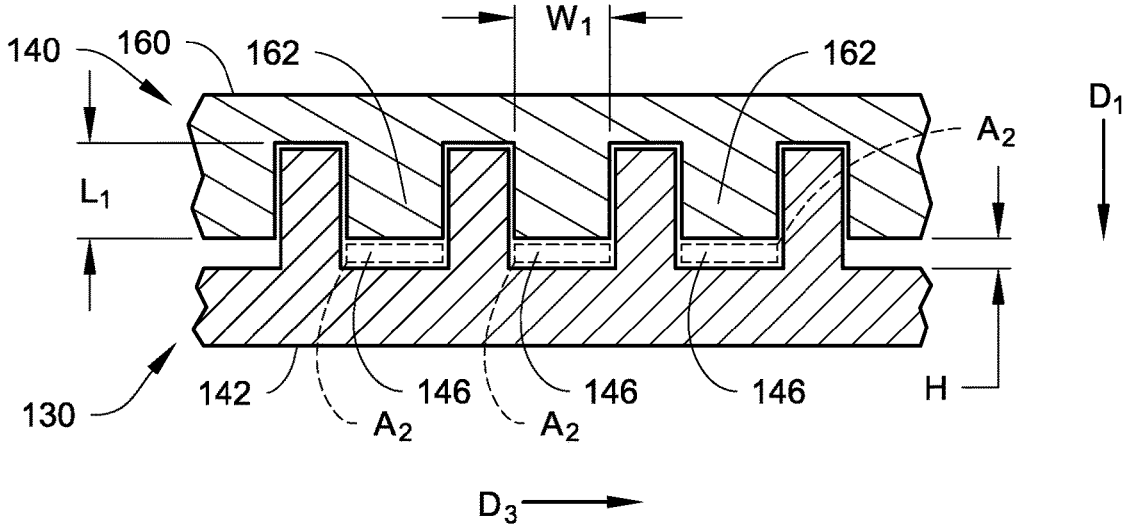

FIGS. 10 and 11 are schematics diagrams illustrating the intermeshing of the throttle ring 160 and the flow guide plate 140. For example, the view in FIGS. 10 and 11 are a partial cross-section of throttle ring 160 and flow guide plate 140 in the axial direction. FIG. 10 shows the throttle ring 160 in the retracted position (e.g., as shown in FIG. 9). FIG. 11 shows the throttle ring 160 in the extended position (e.g., shown in FIG. 8). The flow direction of the working fluid through the channels 146 would be into the page in FIGS. 10 and 11. For example, radially inward is into the page in FIGS. 10 and 11.

As shown in FIG. 10, the teeth 162 of the throttle ring 160 are spaced apart from each other in the circumferential direction $D_3$. The guide vanes 144 are space apart from each other in the circumferential direction $D_3$ such that the channels 146 are spaced apart from each other in the circumferential direction $D_3$. Each of the teeth 162 has a width $W_1$ in the circumferential direction that is smaller than the width $W_2$ of its respective channel 146 such that the teeth 162 fit into their respective channels 146. A gap is formed between adjacent pair of teeth 162

As shown in FIG. 10, each of the channels 146 has a cross sectional area $A_1$ when the throttle ring 160 is in its retracted position. The working fluid flows through the channels 146 by passing through the cross-sectional area $A_1$ between the flow guide plate 140 and the tips 164 of the teeth 162. In the illustrated embodiment, the teeth 162 of the throttle ring 160 are not disposed in the channels 146 when the throttle ring 160 is in its retracted position. However, it should be appreciated that the throttle ring 160 in an embodiment may be configured such that the throttle ring 160 is not fully removed from the channels 146 when in its retracted position (e.g., part of the teeth 162 can remain disposed in the channels 146 when in the retracted position).

When actuated into the extended position as shown in FIG. 11, the throttle ring 160 moves closer to the flow guide plate 140 in the axial direction $D_1$ and the teeth 162 are disposed in the channels 146. The movement of the throttle ring 160 disposes a greater length Li of the teeth 162 in the channels 146 and moves the teeth 162 closer to the baseplate 142 of the flow guide plate 140. The teeth 162 and channels 146 intermesh together in the extended position. Each tooth 162 is disposed in its respective channel 146 and between a respective adjacent pair (e.g., adjacent in the circumferential direction $D_3$) of the guide vanes 144.

When moved to the extended position, the teeth 162 partially block the channels 146 and reduce the open height H of the channels. The blocking of the channels 146 reduces their open cross sectional area $A_2$ at the teeth 162. This creates a pressure drop for the working fluid to flow through the smaller cross sectional area $A_2$ which reduces the flow rate of the working fluid through the channels 146 (e.g., the flow rate of the working fluid through the interstage throttle 130).

Figure 12:
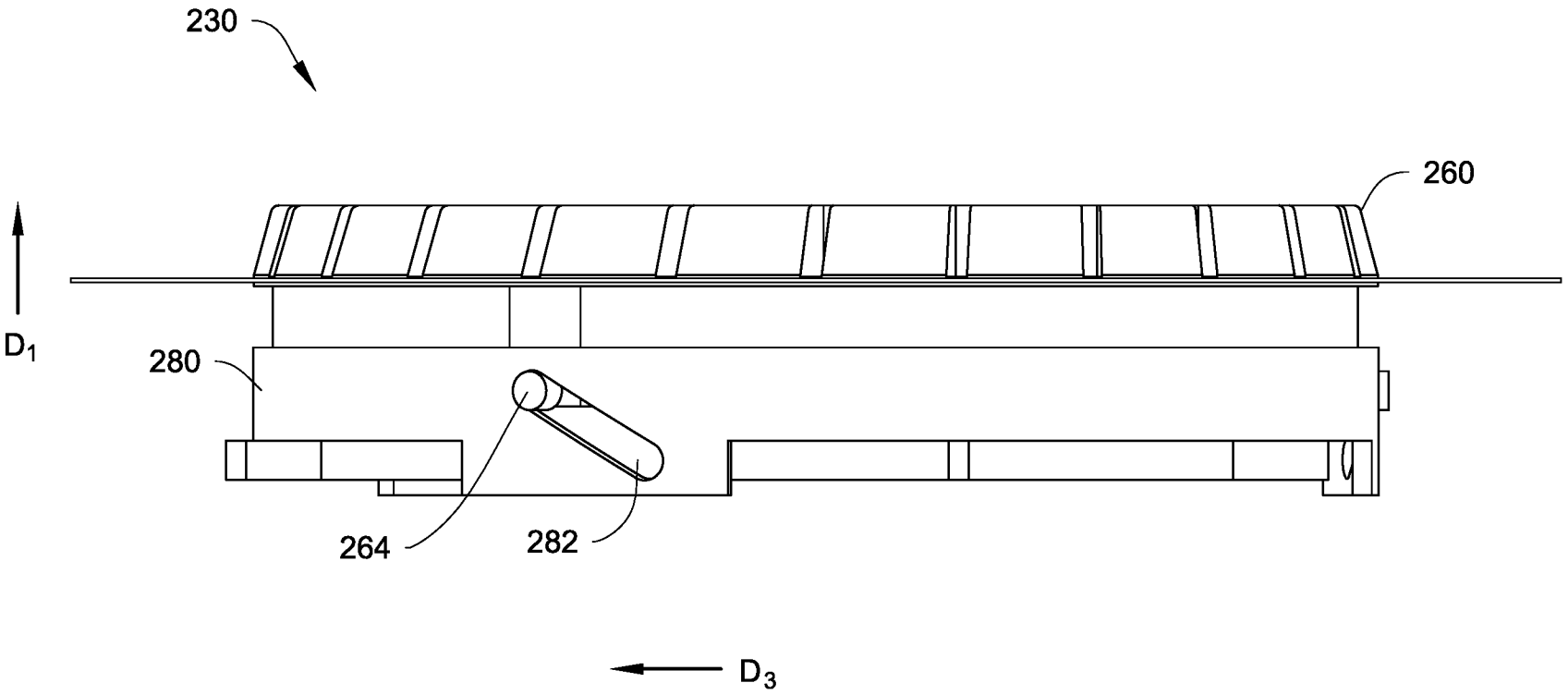
FIG. 12 is a side view of an embodiment of a throttle ring and a drive ring for an interstage throttle.

FIG. 12 is a side view of another embodiment of a drive linkage 282 for connecting a drive ring 280 to a throttle ring 260 in an interstage throttle 230. For example, the interstage throttle 230 may have features similar to the interstage throttle in FIG. 5 except as described below. The throttle ring 260 is actuated by rotating the drive ring 280. For example, the rotational axis of the drive ring 280 would extend vertically in FIG. 12 such that rotation of the drive ring 280 in the circumferential direction $D_3$ would cause left side of the drive ring 280 to move into the page and the right side of the drive ring 280 to move out of the page. For example, an actuator and actuation linkage assembly similar to the actuator 170 and actuation linkage assembly 172 as described above can be used to drive the drive ring 280 to rotate. The rotation of the drive ring 280 causes the throttle ring 260 to move in the axial direction (e.g., positive axial direction $D_1$). FIG. 12 shows the throttle ring 260 in its extended position. The throttle ring 260 is moved in the axial direction (e.g., opposite to the positive axial direction $D_1$) by rotating the drive ring 280 in the opposite direction (e.g., opposite to the circumferential direction $D_3$).

In the illustrated embodiment, the drive linkage 282 is a slot in the drive ring 280. A radial shaft 264 of the throttle ring 260 extends through the slot. The slot is angled between the axial direction $D_1$ and circumferential direction $D_3$ such that the rotation of drive ring 280 forces the radial shaft 264 to move axially within the slot which moves the throttle ring 260 in the axial direction $D_1$. In FIG. 12, the drive ring 280 has been rotated in a first direction (e.g., circumferential direction $D_3$) to move the radial shaft 264 to the end of the slot closest to the throttle ring 260 (e.g., to move the throttle ring 260 to its extended position). The drive ring 280 is then rotated in the opposite direction (e.g., opposite to the circumferential direction $D_3$ in FIG. 12) moving the radial shaft 264 in the opposite direction until reaching the end of the slot farthest from the throttle ring 260 (e.g., moving the throttle ring 260 to its retracted position). A respective drive linkage 282 (e.g., a respective slot in the drive ring 280) can be provided for each radial shaft 264 of the throttle ring 260 as similarly discussed for the drive linkages in FIGS. 7-9. In an embodiment, support linkages (e.g., support linkages 184) provided for throttle ring 260 similar to the throttle ring 160 in FIGS. 7-10 such that the rotation of the throttle ring 260 when actuated in the axial direction is limited. For example, a support linkage is provided for the radial shaft 264 that limits/prevents the radial shaft 264 in the circumferential direction $D_3$ while allowing the radial shaft 264 to move axially within the slot when the drive ring 280 is rotated.

Figure 13:
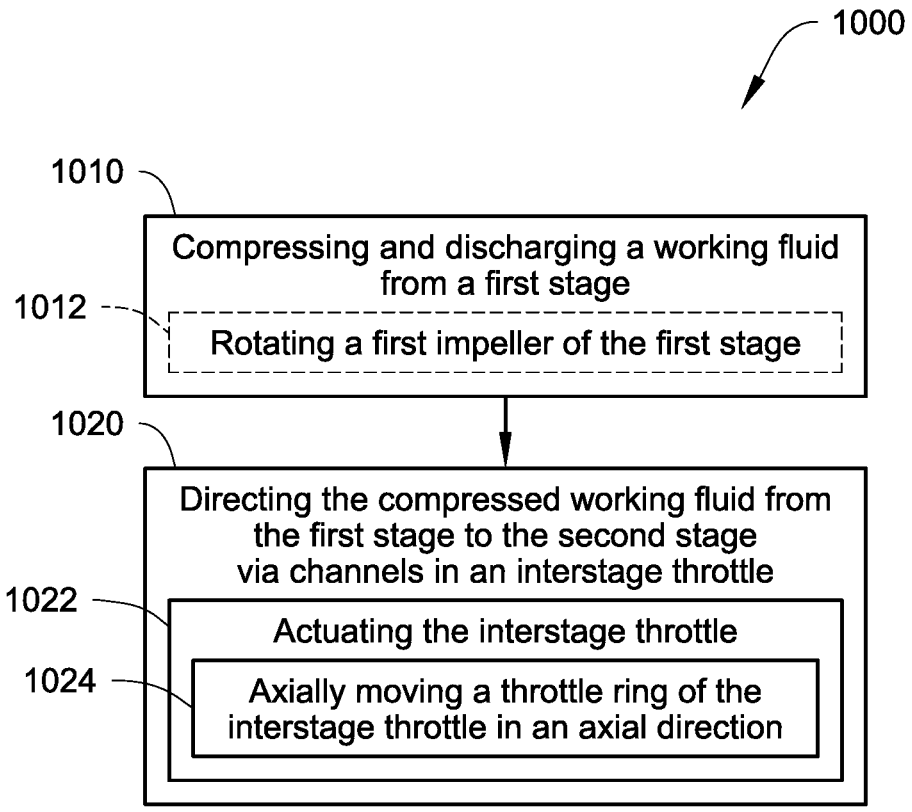
FIG. 13 is a block flow diagram for an embodiment of a method of operating a centrifugal compressor.

FIG. 13 is a block diagram of a method 1000 of operating a centrifugal compressor. In an embodiment, the method 1000 may be applied to the centrifugal compressor 100 of FIG. 1. The method starts at 1010.

At 1010, working fluid is compressed in and discharged from a first stage (e.g., first stage $S_1$) of the compressor. Compressing the working fluid in the first stage 1010 may include rotating a first impeller (e.g., first impeller 110A) of the first stage 1012. The rotating of the first impeller at 1012 compresses the working fluid from an inlet pressure to a higher pressure (e.g., first pressure) and radially discharges the compressed working fluid from the first impeller 110A at the first pressure 1012. The method 1010 then proceeds from 1010 to 1020.

At 1020, the compressed working fluid is directed from the first stage to a second stage of the compressor (e.g., second stage $S_2$) via channels (e.g., channels 146) in an interstage throttle (e.g., interstage throttle 130). The compressed working fluid flowing from the first stage to the second stage through the channels in the interstage throttle. Directing the compressed working fluid at 1020 includes actuating the interstage throttle 1022 to control the flow (e.g., flowrate) of the working fluid to the second stage. Actuating the interstage throttle at 1022 includes axially moving a throttle ring of the interstage throttle (e.g., throttle ring 160, 260) 1024. Actuating the throttle ring at 1024 includes rotating a drive ring (e.g., drive ring 180) connected to the throttle ring. The rotation of the drive ring moving the throttle ring in an axial direction closer to the channels. For example, the movement of the throttle ring in the axial direction closer to the channels reduces the cross-sectional areas (e.g., area $A_1$, area $A_2$) of the channels and reduces the flowrate of the working fluid through the interstage throttle 130. The compressor (e.g., a controller of the compressor) is configured to adjust the position of the interstage throttle 130 to control the capacity of the compressor (e.g., the volumetric discharge from the compressor) to match a desired capacity based on the cooling or heating to be provided by the HVACR system (e.g., heating or cooling to be provided by the heat transfer circuit 1).

It should be appreciated that the method 1000 in an embodiment may be modified to have features as discussed above for the compressor 10 in FIG. 1, the compressor 100 in FIGS. 2-4, the interstage throttle 130 in FIGS. 5-11, and/or the interstage throttle 230 in FIG. 12.

Aspects:

Any of Aspects 1-9 can be combined with any of Aspects 10-20 and any of aspects 10-12 can be combined with Aspects 13-20.

Aspect 1. An interstage throttle for a centrifugal compressor including a first stage and a second stage, the interstage throttle comprising: a flow guide plate including a plurality of guide vanes forming channels extending radially inward, the channels configured to direct working fluid discharged from the first stage to an inlet of the second stage; a throttle ring including teeth; a drive ring; linkage assemblies connecting the drive ring to the throttle ring such that rotation of drive ring moves the throttle ring in an axial direction relative to the flow guide plate between a retracted position and an extended position, wherein in the extended position, the teeth of the throttle ring are disposed in and partially block the channels.

Aspect 2. The interstage throttle of Aspect 1, wherein the teeth of the throttle ring block less of the channels in the retracted position than in the extended position.

Aspect 3. The interstage throttle of any one of Aspects 1 and 2, wherein the throttle ring includes radial shafts, each of the linkage assemblies include pairs of a drive linkage and a support linkage connected to the radial shafts of the throttle ring, the drive linkage and the support linkage in each of the pairs connected to the same respective one of the radial shafts on the throttle ring.

Aspect 4. The interstage throttle ring any one of Aspect 3, further comprising: a housing, the flow guide plate, the throttle ring, and the drive ring disposed within the housing, wherein the drive linkages connect the drive ring to the throttle ring, the drive linkages configured to transfer rotation of the drive ring into axial movement of the throttle ring, and the support linkages connect the throttle ring to the housing, the support linkages configured to prevent rotation of the throttle ring.

Aspect 5. The interstage throttle ring of any one of Aspects 3 and 4, wherein in each of the pairs of the drive linkage and the support linkage: the drive linkage has a first end rotatably connected to the respective radial shaft on the throttle ring and a second end rotatably connected to a respective radial shaft on the drive ring.

Aspect 6. The interstage throttle ring of any one of Aspects 3-5, wherein in each of the pairs of the drive linkage and the support linkage: the support linkage has a first end connected to the respective radial shaft on the throttle ring and a second end connected to a housing of the interstage throttle.

Aspect 7. The interstage throttle of any one of Aspects 1-6, further comprising: an actuator and an actuation linkage assembly connecting the actuator to the drive ring, actuation of the actuator extends the actuator causes rotation of the drive ring, and retraction of the actuator causes opposite rotation of the drive ring.

Aspect 8. The interstage throttle of any one of Aspects 1-7, wherein rotation of the throttle ring from the retracted position to the extended position is less than 5 degrees.

Aspect 9. The interstage throttle of any one of Aspects 1-8, wherein the flow guide plate is configured to have a fixed position in the interstage throttle.

Aspect 10. A method of operating a centrifugal compressor, comprising: compressing a working fluid to a first pressure in the first stage; directing the working fluid discharged from the first stage to a second stage via channels in a interstage throttle, the interstage throttle including a flow guide plate including a plurality of guide vanes forming the channels extending radially inward, a throttle ring, a drive ring, and linkage assemblies connecting the drive ring to the throttle ring, wherein the directing of the working fluid via the channels includes: rotating the drive ring to move the throttle ring in an axial direction relative to the flow guide plate between a retracted position and an extended position, the rotation of the drive ring moving the throttle ring between in the axial direction between the retracted position and the extended position, the throttle ring in the extended position having teeth disposed in and partially blocking the channels.

Aspect 11. The method of Aspect 10, further comprising: further compressing the working fluid in the second stage from the first pressure to a second pressure.

Aspect 12. The method of any one of Aspects 10 and 11, wherein the rotating of the drive ring includes extending or retracting an actuator connected to the drive ring, the extending or retracting of the actuator causing rotation of the drive ring.

Aspect 13. A centrifugal compressor, comprising: a first stage including a first impeller configured to compress working fluid to a first pressure; a second stage including a second impeller configured to compress the working fluid to a second pressure; an interstage throttle fluidly connecting the first stage to the second stage, the interstage throttle including: a flow guide plate including a plurality of guide vanes forming channels extending radially inward, the channels configured to direct the working fluid discharged from the first stage at the first pressure to an inlet of the second stage, a throttle ring including teeth, a drive ring, and linkage assemblies connecting the drive ring to the throttle ring such that rotation of the drive ring moves the throttle ring in an axial direction relative to the flow guide plate between a retracted position and an extended position, wherein in the extended position, the teeth of the throttle ring are disposed in and partially block the channels.

Aspect 14. The centrifugal compressor of Aspect 13, wherein the teeth of the throttle ring block less of the channels in the retracted position than in the extended position.

Aspect 15. The centrifugal compressor of any one of Aspects 13 and 14, wherein the throttle ring includes radial shafts, each of the linkage assemblies include pairs of a drive linkage and a support linkage connected to the radial shafts of the throttle ring, the drive linkage and the support linkage in each of the pairs connected to the same respective one of the radial shafts on the throttle ring.

Aspect 16. The centrifugal compressor of Aspect 15, further comprising: a housing, the flow guide plate, the throttle ring, and the drive ring disposed within the housing, wherein the drive linkages connect the drive ring to the throttle ring, the drive linkages configured to transfer rotation of the drive ring into axial movement of the throttle ring, and the support linkages connect the throttle ring to the housing, the support linkages configured to prevent rotation of the throttle ring.

Aspect 17. The centrifugal compressor of any one of Aspects 13-16, further comprising: an actuator and an actuation linkage assembly connecting the actuator to the drive ring, actuation of the actuator extends the actuator causing rotation of the drive ring, and retraction of the actuator causes opposite rotation of the drive ring.

Aspect 18. The centrifugal compressor of Aspect 17, further comprising: a housing, wherein the flow guide plate, the throttle ring, and the drive ring are disposed within the housing, the actuator is external to the housing, and the actuation linkage assembly extends through the housing.

Aspect 19. The centrifugal compressor of any one of Aspects 13-18, wherein rotation of the throttle ring from the retracted position to the extended position is less than 5 degrees.

Aspect 20. The centrifugal compressor of any one of Aspects 13-19, wherein the flow guide plate is configured to have a fixed position within the centrifugal compressor.

The terminology used herein is intended to describe particular embodiments and is not intended to be limiting. The terms "a," "an," and "the" include the plural forms as well, unless clearly indicated otherwise. The terms "comprises" and/or "comprising," when used in this Specification, specify the presence of the stated features, integers, steps, operations, elements, and/or components, but do not preclude the presence or addition of one or more other features, integers, steps, operations, elements, and/or components. In an embodiment, "connected" and "connecting" as described herein can refer to being "directly connected" and "directly connecting".

With regard to the preceding description, it is to be understood that changes may be made in detail, especially in matters of the construction materials employed and the shape, size, and arrangement of parts without departing from the scope of the present disclosure. This Specification and the embodiments described are exemplary only, with the true scope and spirit of the disclosure being indicated by the claims that follow.

What is claimed is:

1. An interstage throttle for a centrifugal compressor including a first stage and a second stage, the interstage throttle comprising:

a flow guide plate including a plurality of guide vanes forming channels extending radially inward, the channels configured to direct working fluid discharged from the first stage to an inlet of the second stage;

a throttle ring, the throttle ring including radial shafts;

a drive ring; and linkage assemblies connecting the drive ring to the throttle ring such that rotation of the drive ring moves the throttle ring in an axial direction relative to the flow guide plate between a retracted position and an extended position, the linkage assemblies including respective pairs of a drive linkage and a support linkage connected to the radial shafts of the throttle ring, the drive linkage and the support linkage in each of the respective pairs connected to the same respective one of the radial shafts on the throttle ring, wherein in the extended position, the throttle ring is disposed to partially block the channels.

2. The interstage throttle of claim 1, wherein the throttle ring blocks less of the channels in the retracted position than in the extended position.

3. The interstage throttle ring of claim 1, further comprising:

a housing, the flow guide plate, the throttle ring, and the drive ring disposed within the housing, wherein the drive linkages connect the drive ring to the throttle ring, the drive linkages configured to transfer rotation of the drive ring into axial movement of the throttle ring, and the support linkages connect the throttle ring to the housing, the support linkages configured to prevent rotation of the throttle ring.

4. The interstage throttle ring of claim 1, wherein in each of the respective pairs of the drive linkage and the support linkage:

the drive linkage has a first end rotatably connected to the respective radial shaft on the throttle ring and a second end rotatably connected to a respective radial shaft on the drive ring.

5. The interstage throttle ring of claim 1, wherein in each of the respective pairs of the drive linkage and the support linkage:

the support linkage has a first end connected to the respective radial shaft on the throttle ring and a second end connected to a housing of the interstage throttle.

6. The interstage throttle of claim 1, further comprising:

an actuator and an actuation linkage assembly connecting the actuator to the drive ring, actuation of the actuator extends the actuator causes rotation of the drive ring, and retraction of the actuator causes opposite rotation of the drive ring.

7. The interstage throttle of claim 1, wherein rotation of the throttle ring from the retracted position to the extended position is less than 5 degrees.

8. The interstage throttle of claim 1, wherein the flow guide plate is configured to have a fixed position in the interstage throttle.

9. A method of operating a centrifugal compressor, comprising: compressing a working fluid to a first pressure in the first stage; and directing the working fluid discharged from the first stage to a second stage via channels in a interstage throttle, the interstage throttle including a flow guide plate including a plurality of guide vanes forming the channels extending radially inward, a throttle ring, a drive ring, and linkage assemblies connecting the drive ring to the throttle ring, the throttle ring including radial shafts, the linkage assemblies including respective pairs of a drive linkage and a support linkage connected to the radial shafts of the throttle ring, the drive linkage and the support linkage in each of the respective pairs connected to the same respective one of the radial shafts on the throttle ring, wherein the directing of the working fluid via the channels includes:

rotating the drive ring to move the throttle ring in an axial direction relative to the flow guide plate between a retracted position and an extended position, the rotation of the drive ring moving the throttle ring in the axial direction between the retracted position and an extended position, the throttle ring in the extend position is disposed to partially block the channels.

10. The method of claim 9, further comprising:

further compressing the working fluid in the second stage from the first pressure to a second pressure.

11. The method of claim 9, wherein the rotating of the drive ring includes extending or retracting an actuator connected to the drive ring, the extending or retracting of the actuator causing rotation of the drive ring.

12. A centrifugal compressor, comprising:

a first stage including a first impeller configured to compress working fluid to a first pressure;

a second stage including a second impeller configured to compress the working fluid to a second pressure; and an interstage throttle fluidly connecting the first stage to the second stage, the interstage throttle including:

a flow guide plate including a plurality of guide vanes forming channels extending radially inward, the channels configured to direct the working fluid discharged from the first stage at the first pressure to an inlet of the second stage, a throttle ring, the throttle ring including radial shafts, a drive ring, and linkage assemblies connecting the drive ring to the throttle ring such that rotation of the drive ring moves the throttle ring in an axial direction relative to the flow guide plate between a retracted position and an extended position, the linkage assemblies including respective pairs of a drive linkage and a support linkage connected to the radial shafts of the throttle ring, the drive linkage and the support linkage in each of the respective pairs connected to the same respective one of the radial shafts on the throttle ring, wherein in the extended position, the throttle ring is disposed to partially block the channels.

13. The centrifugal compressor of claim 12, wherein the throttle ring blocks less of the channels in the retracted position than in the extended position.

14. The centrifugal compressor of claim 12, further comprising:

a housing, the flow guide plate, the throttle ring, and the drive ring disposed within the housing, wherein the drive linkages connect the drive ring to the throttle ring, the drive linkages configured to transfer rotation of the drive ring into axial movement of the throttle ring, and the support linkages connect the throttle ring to the housing, the support linkages configured to prevent rotation of the throttle ring.

15. The centrifugal compressor of claim 12, further comprising:

an actuator and an actuation linkage assembly connecting the actuator to the drive ring, actuation of the actuator extends the actuator causing rotation of the drive ring, and retraction of the actuator causes opposite rotation of the drive ring.

16. The centrifugal compressor of claim 15, further comprising:

a housing, wherein the flow guide plate, the throttle ring, and the drive ring are disposed within the housing, the actuator is external to the housing, and the actuation linkage assembly extends through the housing.

17. The centrifugal compressor of claim 12, wherein rotation of the throttle ring from the retracted position to the extended position is less than 5 degrees.

18. The centrifugal compressor of claim 12, wherein the flow guide plate is configured to have a fixed position within the centrifugal compressor.

* * * * *